US006878076B2

(12) United States Patent
Winskowicz

(10) Patent No.: US 6,878,076 B2
(45) **Date of Patent: *Apr. 12, 2005**

(54) GOLF BALL WITH MOISTURE EXPOSURE INDICATOR

(75) Inventor: Robert T. Winskowicz, Andover, MA (US)

(73) Assignee: Performance Indicator, LLC, Topsfield, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/669,103

(22) Filed: Sep. 23, 2003

(65) Prior Publication Data

US 2004/0058753 A1 Mar. 25, 2004

Related U.S. Application Data

(63) Continuation of application No. 09/998,098, filed on Nov. 30, 2001, now Pat. No. 6,623,382, which is a continuation of application No. 09/465,277, filed on Dec. 16, 1999, now Pat. No. 6,358,160, which is a continuation-in-part of application No. 09/327,590, filed on Jun. 8, 1999, now Pat. No. 6,277,037, which is a continuation-in-part of application No. 09/146,476, filed on Sep. 3, 1998, now Pat. No. 5,938,544, which is a continuation of application No. 08/943,584, filed on Oct. 3, 1997, now Pat. No. 5,823,891.

(51) Int. Cl.[7] ..... A63B 37/12

(52) U.S. Cl. ..... 473/378; 473/353; 473/354; 473/365; 473/377

(58) Field of Search ..... 473/353, 354, 473/365, 377, 378

(56) References Cited

U.S. PATENT DOCUMENTS

| | | | |
|---|---|---|---|
| 3,264,272 | A | 8/1966 | Rees |
| 3,572,722 | A | 3/1971 | Harrison et al. |

(Continued)

FOREIGN PATENT DOCUMENTS

| | | |
|---|---|---|
| JP | 06248207 | 9/1994 |
| WO | 17844 | 4/1999 |

*Primary Examiner*—John A. Ricci
(74) *Attorney, Agent, or Firm*—Wilmer Cutler Pickering Hale and Dorr LLC

(57) ABSTRACT

A golf ball is provided which changes color or other indicia after exposure to moisture to indicate that the ball may not have predictable flight characteristics which may result in loss of carry and roll. In one embodiment, a microencapsulated dye layer is formed immediately below the final gloss coat, with controlled dye release causing a stained look to the ball after significant exposure to moisture. In another embodiment, the dye or ink is provided in pelletized form for ease of manufacture. In other embodiments, a dye, ink, or chemical is compounded with other materials and introduced into or applied onto the golf balls composite materials in a solid, liquid, or gaseous form. In still other embodiments imprints on the ball are made with a water activated ink which either appears or disappears upon the exposure of the golf ball to moisture.

4 Claims, 6 Drawing Sheets

U.S. PATENT DOCUMENTS 3,784,209 A 1/1974 Berman et al.
4,065,537 A 12/1977 Miller et al.
4,266,772 A 5/1981 Martin et al.
4,431,193 A 2/1984 Nesbitt
4,436,276 A 3/1984 Donahue ..... 249/91
4,483,537 A 11/1984 Hanada et al.
4,625,964 A 12/1986 Yamada
4,679,795 A 7/1987 Melvin et al. ..... 473/356
4,683,257 A 7/1987 Kakiuchi et al. ..... 524/432
4,688,801 A 8/1987 Reiter
4,690,981 A 9/1987 Statz ..... 525/329.6
4,714,253 A 12/1987 Nakahara et al.
4,715,607 A 12/1987 Llort et al.
4,792,141 A 12/1988 Llort
4,848,770 A 7/1989 Shama
4,863,167 A 9/1989 Matsuki et al.
4,884,814 A 12/1989 Sullivan
4,911,451 A 3/1990 Sullivan et al.
4,919,434 A 4/1990 Saito
4,931,376 A 6/1990 Ikematsu et al. ..... 526/164
4,955,966 A 9/1990 Yuki et al.
4,979,746 A 12/1990 Gentiluomo
4,984,803 A 1/1991 Llort et al.
5,002,281 A 3/1991 Nakahara et al.
5,006,297 A 4/1991 Brown et al. ..... 264/234
5,096,201 A 3/1992 Egashira et al.
5,098,104 A 3/1992 Kane ..... 473/377
5,160,536 A * 11/1992 Harris et al. ..... 106/31.37
5,314,187 A 5/1994 Proudfit
5,356,149 A * 10/1994 Kane ..... 473/371
5,415,937 A 5/1995 Cadorniga
5,480,155 A 1/1996 Molitor et al.
5,496,035 A 3/1996 Gilchrist et al.
5,538,794 A 7/1996 Cadorniga et al. ..... 428/407
5,586,950 A 12/1996 Endo ..... 473/356
5,609,953 A 3/1997 Tamura ..... 428/316.6
5,823,891 A 10/1998 Winskowicz ..... 473/378
5,902,192 A 5/1999 Kashiwagi et al. ..... 473/327
5,938,544 A 8/1999 Winskowicz ..... 473/378
6,540,624 B1 * 4/2003 Isogawa ..... 473/371
2002/0001847 A1 * 1/2002 Elhard et al. ..... 436/39
2002/0045493 A1 * 4/2002 Isogawa et al. ..... 473/351
2003/0027663 A1 * 2/2003 Okido et al. ..... 473/351
2004/0139867 A1 * 7/2004 Chudy ..... 101/35
2004/0142765 A1 * 7/2004 Kennedy et al. ..... 473/351

* cited by examiner

GOLF BALL WITH MOISTURE EXPOSURE INDICATOR

CROSS REFERENCE TO RELATED APPLICATIONS

This application is a continuation of U.S. patent application Ser. No. 09/465,277, filed on Dec. 16, 1999 now U.S. Pat. No. 6,358,160, which was a continuation-in-part of U.S. patent application Ser. No. 09/327,590 filed on Jun. 8, 1999, now U.S. Pat. No. 6,277,037 which was a continuation-in-part of U.S. patent application Ser. No. 09/146,476 filed Sep. 3, 1998, now U.S. Pat. No. 5,938,544 which was a continuation of Ser. No. 08/943,584 filed on Oct. 3, 1997, now U.S. Pat. No. 5,823,891.

BACKGROUND OF THE INVENTION

As indicated in the September, 1996 issue of "Golf Digest", hitting golf balls into the water occurs with a great degree of frequency. As a result, an entire industry has developed in the recovery of golf balls which are then resold despite the fact that the ball has spent a fair amount of time in the water. While the golf ball cover seems to be fairly impervious, the question has become as to the effect of the immersion of the ball over a number of days at the bottom of a pond laying in the mud.

As will be appreciated, golf balls come in two varieties, a three-piece ball and a two-piece ball. According to the above article, when such balls were tested using a robotic hitting machine and a standard length metal driver with a 9.53 degree loft and an extra stiff shaft, with a club head speed 93.7 miles per hour and a launch angle of 9.0 degrees and with a spin rate of 2,800 rpm, the result for a three-piece ball was a difference in carry of 6 yards after an eight day immersion, a 12 yard loss after three months and a 15 yard loss after six months.

For a two-piece ball, the amount of carry was 6 yards shorter and after having been immersed for eight days was a total of 9.1 yards shorter. While for two-piece balls being in the water typically makes the ball harder in terms of compression, it also shows down the coefficient of restitution or the ability of the ball to regain its roundness after impact. The above factors make the ball fly shorter. Three-piece balls have been found to get softer in terms of compression, but they also fly shorter according to the above-mentioned article.

Whatever the results of the immersion of a golf ball in a pond, the characteristics of the ball in flight are altered by the immersion. The problem therefore becomes one of being able to determine when a golf ball has been immersed so that it may be rejected in favor of a new golf ball.

Note that golf ball construction is shown in the following U.S. Pat. Nos. 5,609,953; 5,586,950; 5,538,794; 5,496,035; 5,480,155; 5,415,937; 5,314,187; 5,096,201; 5,006,297; 5,002,281; 4,690,981; 4,984,803; 4,979,746; 4,955,966; 4,931,376; 4,919,434; 4,911,451; 4,884,814; 4,863,167; 4,848,770; 4,792,141; 4,715,607; 4,714,253; 4,688,801; 4,683,257; 4,625,964; 4,483,537; 4,436,276; 4,431,193; 4,266,772; 4,065,537; 3,704,209; 3,572,722; 3,264,272.

SUMMARY OF INVENTION

In order to alleviate the problem of having to deal with balls which may have been immersed and recovered, in the subject invention a golf ball is provided which changes color, has imprinted writing which disappears or has some other indicia which changes after immersion to indicate that the ball has been immersed.

In the present invention, in one embodiment, imprints on the ball are made with water-activated ink which vanishes when it is exposed to water for long periods of time. In another embodiment, imprints on the ball are made with water-activated transparent ink which appears when it is exposed to water for long periods of time. The invention is thus used as an indicator of balls previously exposed to water to for one to several days in the bottom of a lake, pond, pool or other body of water. Such an indicator is used to alert golfers to potential changes in ball properties due to long water exposure times.

BRIEF DESCRIPTION OF THE DRAWINGS

These and other features of the subject invention will be better understood when taken in conjunction with the Detailed Description the Drawings of which.

DETAILED DESCRIPTION OF THE PREFERRED EMBODIMENTS

Figure 1:
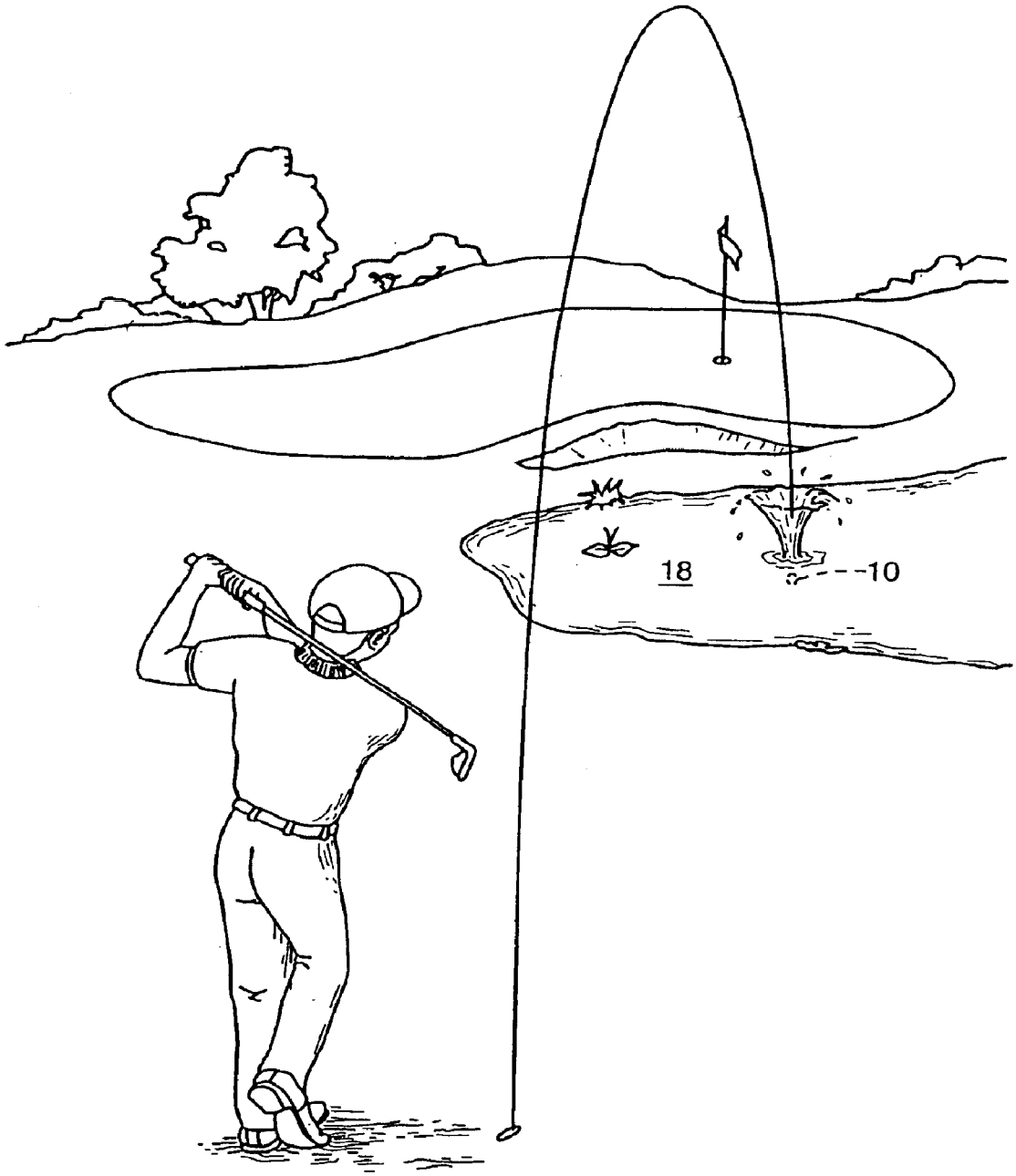
FIG. 1 is a diagrammatic illustration of a golfer hitting a golf ball into a water hazard.

Referring now to FIG. 1, in a typical situation, a ball 10 has been hit by a golfer 12 into a water hazard 13, where it resides until it is plucked out either by the golfer or by a company which retrieves golf balls from water hazards. It will be appreciated that, as mentioned before, such balls when immersed for a long period of time lose their flight characteristics, and regardless of their being washed and resold, will not regain these characteristics due to the immersion.

Figure 2:
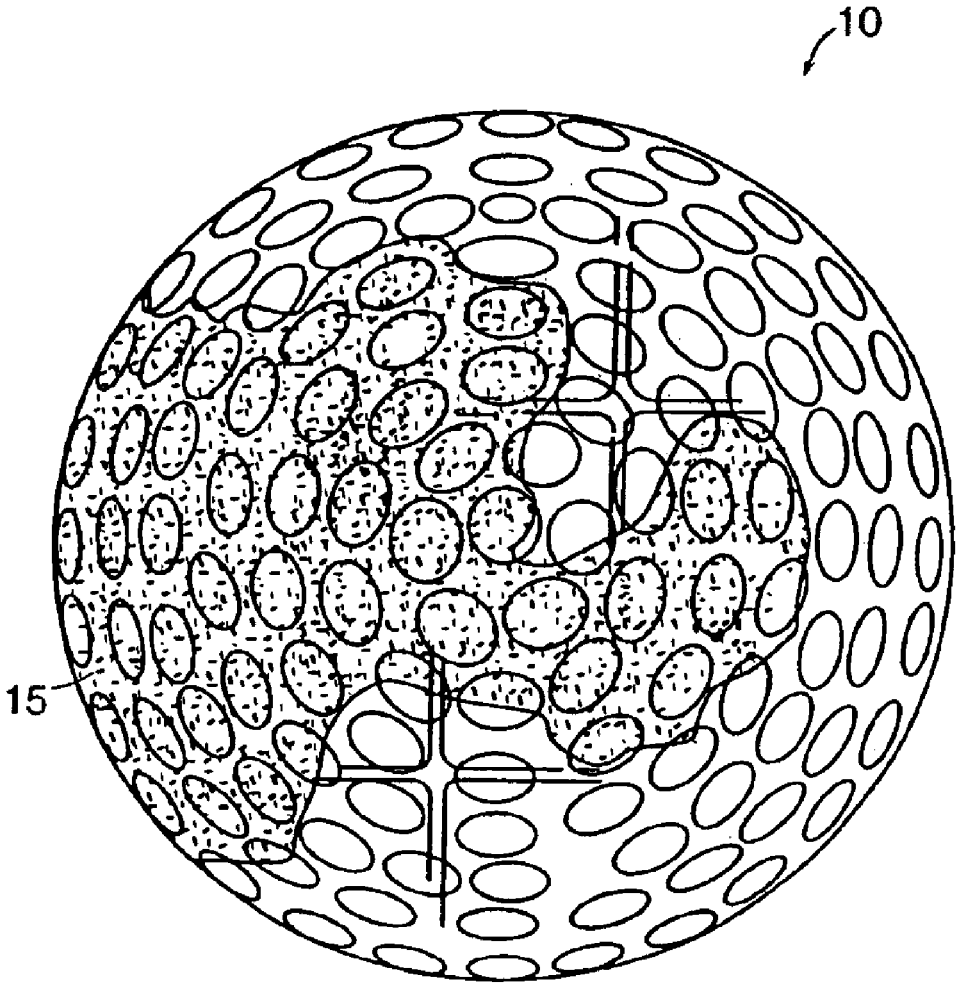
FIG. 2 is a diagrammatic illustration of the ball of FIG. 1 after immersion in water, showing a visual indicator that the ball has been immersed in water for an extended period of time.

In order to provide an indicator of golf balls that have been immersed in water for some time, and referring now to FIG. 2, it can be seen that golf ball 10 is provided with a mottled appearance 15, which serves as an indicator that the ball has been immersed in water.

It is this or some other indicator which is water activated that provides a convenient method for the purchaser of a golf ball to ascertain that the ball is in fact a used ball and one which has been immersed in water for some time or has been subjected to some other predetermined condition.

As will be described, in one embodiment this distinctive discoloration or indication is provided through the utilization of water soluble inks or dyes which are activated through the infusion of water into encapsulated dye particles in one embodiment. The result of the infusion of water is that the dye particles emit their dyes to mark the golf ball in some distinctive manner. Whether it is with dyes or inks which are water soluble or are released upon water activation, it is immaterial as to what type of indication is given so long as the golfer purchasing the golf ball can ascertain that it is in fact one that has been immersed in water or is otherwise unsuitable for play.

It is noted that controlled release technology is a well-proven means of slowly delivering a small amount of a compound over a given time period or at a specific time based on a desired stimulus. In the subject invention controlled release technology is used as an approach to the slow color change of a golf ball in water. The subject invention, in one embodiment, involves the use of inks or dyes which are micro-encapsulated with a thin polymer coating to form small particles or beads. These micro-capsules, which may vary in size from tens of microns to millimeters, can be incorporated into a hard, glassy polymer coating material such as polymethyl methacrylate or polyvinyl acrylate ester, which can act as a gloss coat for the ball, or the encapsulant can be incorporated into the rubber or ionomer cover of the ball itself.

A microencapsulant is a polymer coating used to enclose a liquid or solid material within a small particle. Microencapsultants are generally in the range of tens to hundred of microns in diameter. Encapsulation approaches have been used for a number of applications in which a compound must be slowly but systematically released to an environment under the desired conditions. Examples include microcapsules in drug delivery, vitalizing nutrients or proteins in time release cosmetic products and fertilizers or pesticides for agricultural products.

The polymer coating may consist of a broad range of potential polymeric materials and polymer blends. The basis for most controlled release technology is the slow diffusion of the encapsulated product through the polymer coating or matrix and into the surrounding environs. The driving force for diffusion is mass transfer from the highly concentrated interior to the dilute exterior regions. The diffusion process is often accelerated or activated by the presence of a solvent that swells or partially solvates the polymer film, thus plasticizing the polymer film and increasing the effective diffusivity of the polymer matrix. The result is a faster rate of transport of the encapsulated material out of the microcapsule.

A second route to controlled release systems is the slow dissolution of an uncrosslinked or linear polymer coating in a good solvent, resulting in the release of the encapsulated compound as the coating walls become thinner and ultimately dissolve completely. In this case, the dissolution rate of the polymer, rather than the diffusion rate alone, is the rate determining step in the release of the encapsulant.

A third approach to the controlled release of a material is macro-encapsulation. In this case, the material is slowly released from a continuous polymer matrix, which may be molded into any number of shapes or objects. The primary difference between this approach and that of microencapsulation is that in the latter, the material is enclosed in well defined microspheres on the order of magnitude of several microns, whereas in macroencapsulation, the material of interest is directly enclosed in an object of the order of magnitude of centimeters and greater. Both of these approaches involve the slow diffusion of the material out of the matrix or the encapsulant shell.

Figure 3:
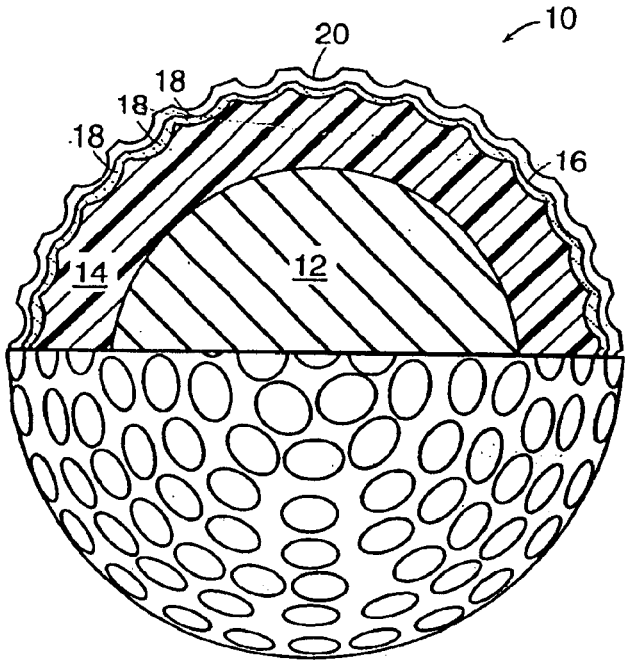
FIG. 3 is a diagrammatic illustration of a two piece ball which provides a visual indicator of elongated water immersion in which the ball includes a solid rubber core and a hard molded shell of an ionomer or ionomer blend such as Surlyn or a similar appropriate polymer resin, with the ball being provided with a conformal overcoat polymer dispersion containing encapsulated dye particles that goes over the shell or mantle of the ball, and with this overcoat then being covered with a final gloss coat containing no dye particles to maintain high gloss finish and provide an additional diffusion barrier on the ball to prevent dye release in humid or moist environments.

Referring now to FIG. 3, in one embodiment of the subject invention a conventional two piece ball 10 with a solid rubber core 12 illustrated having a hard molded shell 14 of an ionomer blend such as Surlyn, or a similar polymer resin. As can be seen, a conformal overcoat polymer dispersion 16 contains encapsulated dye particles 10, with the dispersion going over the shell or mantle of the ball.

This overcoat is then covered with a final gloss coat 20 containing no dye particles to maintain a high gloss finish and provides an additional diffusion barrier on the ball to prevent dye release in humid or moist environments.

Figure 4:
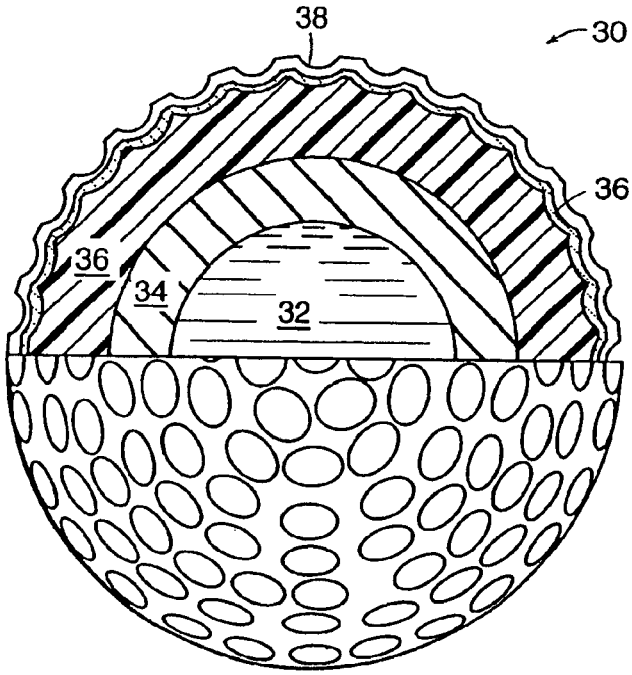
FIG. 4 is a diagrammatic illustration of a three piece ball which provides a visual indication of elongated water immersion in which the ball includes a solid, liquid or gel, a wound rubber band or molded rubber outer core and a shell of a glossy rubbery material such as balata rubber, polybutadiene blends or low shore hardness ionomer and an additional overcoat layer of polymer/encapsulated dye underneath the gloss final coat.

Likewise, for a three piece ball as illustrated in FIG. 4, the three piece ball 30 is provided with a solid, liquid or gel inner core 32, a wound rubber band or molded rubber outer core 34 and a shell 36 of glossy rubber material such as balata rubber, polybutadiene blends or low shore hardness ionomer.

Note that an additional overcoat layer 36 of polymer/encapsulated dye is formed underneath the final gloss coat 38.

Figure 5:
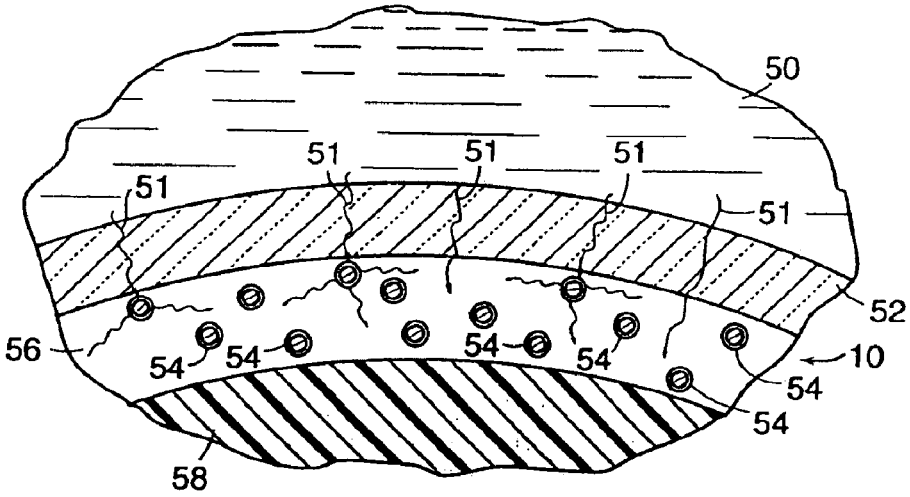
FIG. 5 is a schematic diagram depicting diffusion of water into the ball when it is immersed in a body of water for long time periods.

Referring to FIG. 5 and as will be described, a schematic diagram depicts the diffusion of water 50 into ball 10 when it is immersed in a body of water for a long period of time. Water molecules slowly diffuse as illustrated at 51 into the ball through gloss overcoat 52. In some cases, dye capsules 54 in layer 56 will exist close to the gloss overcoat and away from the shell here illustrated at 58. Water will permeate these capsules first and will then take longer to diffuse to capsules in the bulk of the layer 56. The water will slowly seep into or solvate the microencapsulant allowing controlled diffusion of a water soluble dye out of the polymer microcapsule and gloss overcoat 52, staining the overcoat. Over time, water will diffuse across the layer into the ionomer shell 58 where the ionomer resin will permanently absorb the dye resulting in a deep color change.

A number of different polymers and blends of polymers may be used for microencapsulation coating, including polymethyl methacrylate, polymethacrylic acid, polyacrylic acid, polyacrylates, polvacrylamide, polyacryldextran, polyalkyl cyanoacrylate, cellulose acetate, cellulos acetate butyrate, cellulos nitrate, methyl cellulose and other cellulose derivatives, nylon 6,10, nylon 6,6, nylon 6, polyterephthalamide and other polyamides, polycaprolactones, polydimethylsiloxanes and other siloxanets, aliphatic and aromatic polyesters, polyethylene oxide, polyethylene-vinyl acetate, polyglycolic acid, polylactic acid and copolymers, poly(methyl vinyl ether/maleic anhydride), polystyrene, polyvinyl acetate phthalate, polyvinyl alcohol) polyvinylpyrollidone, shellac, starch and waxes such as paraffin, beeswax, carnauba wax. Polymers used should have a near zero diffusivity of the ink through the polymer matrix in the absence of water. Upon the introduction of water in the surrounding matrix and the subsequent diffusion of water through the polymer film, the diffusivity of the polymer coating for the dye molecules increases, allowing transport of the dye across the polymer film. The ideal polymer systems for this application are those which have a limited permeability to water and thus provide a longer range of diffusion times before releasing the water soluble dye. Such polymers could be crosslinked or uncrosslinked blends of a hydrophobic and a hydrophilic polymer, segmented or block copolymer films with a hydrophilic block or polymers which are not soluble in water, but have a small but finite affinity for water. Such polymers include nylons such as nylon 6,10 or nylon 6, polyacrylonitrile, polyethylene terephthalate (PET), polyvinyl chloride. More water permeable polymers which may be blended with hydrophobic polymers to adjust the dye and water permeability coefficients of the film include cellulose derivatives, polyacrylates, polyethylene oxides, polydimethyl siloxane and polyvinylalcohol.

Dyes that may be used should be water-soluble and may vary from a broad range of industrial dye materials. Ideally, the dye should be compatible with the polymer used for the shell or mantle underneath the dye-encapsulant coating. Ionic and a number of water soluble dyes would be particularly compatible with ionomer materials commonly used in such mantles due to the presence of carboxylate and carboxylic acid groups in the polymer. Some dye Systems change color in the presence of more polar solvents. This effect may be useful if the dye has very little color until exposed to water. Some potential dyes for this application might include merocyanine dyes and pyridinium-N-phenoxide dyes. Examples may include Napthalene Orange G, Crystal Violet, CI Disperse Red and a number of other common industrial dyes. Dyes of larger molecular weight may be desirable, as higher molecular weight dyes diffuse more slowly through a polymer matrix.

Figure 6:
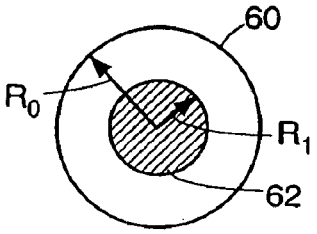
FIG. 6 is a diagrammatic representation of an encapsulated dye particle.

Prior to water exposure, the water-soluble dye is enclosed by a rigid solid polymer film, which is immersed in a nonaqueous medium, with a very low driving force and a high resistance to diffusion through the coating. As shown in FIG. 5, on exposure to water for long time periods, water will slowly diffuse into polymer layer 56 and thence, through microcapsule 60 to dye particle 62 as shown in FIG. 6. The diffusion of the dye out of layer 56 can be modeled using basic mass transfer laws. Note, the rate at which dye diffuses out of the capsule is shown in FIG. 6 to be related to $R_{out}$ and $R_{in}$ for a dye capsule 60 which encapsulates a dye particle 62. Fick's first law is commonly used to model the diffusion process. At steady state, the mass transfer of dye from the microcapsule can be modeled using the equation below:

$$\frac{dM}{dt} = 4TTDK\Delta C\frac{RoRi}{(Ro - Ri)}$$

where dM/dt is the rate of transfer of dye with time, D is the diffusivity of the dye in the polymer layer, K is the solubility of the dye in the layer, C is the concentration difference of the dye in the microcapsule versus the exterior capsule, Ro is the outer diameter and Ri is the inner diameter of the capsule. For a microcapsule that is 50 microns in diameter, with an inner diameter of 45 microns, and thus a wall thickness of 5 microns, the time for diffusion of half of the dye through a polymer film such as nylon could range from ten to one hundred hours, depending on the relative solubility of the dye in the matrix. The diffusion times can be tailored using various polymers or polymers or polymer blends, as well as different materials. Processing the techniques, including the use of a thin secondary top coating layer of pure polymer containing no particles, can control the distribution of ink microparticles to prevent the immediate release of ink from microparticles that may be located at the surface of the ball.

The formation of microcapsules may be done using a number of technologies. These technologies include polymer coacervation/phase separation using the agitation of colloidal suspensions of insoluble polymer and subsequent isolation of microparticles in a nonaqueous medium. Polyamide and some polyester and polyurethane coatings may be formed using interfacial polymerization, using stabilizers to form stabilized microemulsions. Bead suspension polymerization techniques, again using nonaqueous nonsolvent medium, may be used for a number of polymers achieved through free radical polymerization of vinyl polymers such as polyacrylates or acetates, or copolymers. It may be necessary to "hide" the color of the dye, in the microencapsulant if the polymer coating is very transparent. In this case, the incorporation of white pigment in the polymer coating wall can be introduced during the encapsulation process.

After the dye microcapsules are prepared at the desired size and film thickness, the particles may be stored under a desicator, and dried under a vacuum with desiccant at least 24 hours prior to formulation with a polymer film to form an overcoat. The polymer medium for the overcoat can be a traditional gloss coating material such as a polyurethane or polyacrylate. Diffusion limitations of water to the particles will vary with the choice of polymer medium for both the overcoat and gloss coat. Preferred materials may include polyurethanes, polymethyl methacrylate, polyethlyl methacrylate, polybutadiene and various polyvinyls. The particles must be blended in the polymer overcoat film under dry conditions with a humidity of 50% or lower, at loadings of 1 to 30%. The conditions of dispersion may be at temperatures below the flow temperature of microsphere polymer coating, or in an overcoat polymer-solvent mixture with a solvent that cannot dissolve the microsphere polymer coating. Alternatives include the use of crosslinked microspheres, which cannot dissolve or flow under heat, or the use of a crosslinkable liquid monomer or prepolymer. The overcoating can be dip coated or spraycoated onto the ball and cured. A second gloss coating containing no particles may then be applied to the ball. The coating thicknesses of the overcoat and gloss should approximate the thickness of traditional gloss coatings used on conventional golf balls.

EXAMPLE 1

In one configuration, the golf ball can be a two piece golf ball consisting of a wound rubber core and a thick Surlyn ionomer cover containing $TiO_2$, powder and blue as a brightener. Then a translucent coating containing dye particles can be applied. This coating will consist of a soluble nylon, polyester, PET or other barrier coating blended with 5% of dye encapsulant material. If the encapsulated form of the dye is colored, some $TiO_2$ may be added to this layer to ensure whiteness is preserved. Finally, a final gloss coating will be added to the outer layer. The layers important to color change in the ball are the two outermost layers, which should be approximately 100 microns, or 0.1 mm, in thickness.

In the first embodiment, the dye used is a common water soluble dye, Nile Blue. This dye is a crystalline material at room temperature and is available as a granular powder containing crystals that are 20 to 40 microns in size. These solid crystals are hard and non-porous and small enough that when dispersed in a matrix at low concentrations, there will be no detected color change. The individual dye particles would be encapsulated with a gelatin coating using gelatin coacervation in an organic solvent to prevent water solubilization of the dye molecules; procedures for coacervation are well-known, and have been used in drug encapsulation and in the cosmetics and agricultural industries for many years. The encapsulated dye would then be isolated and added in a 1% by mass concentration to a polymeric gloss coating such as a polyurethane or polyester gloss coat. The two piece Surlyn coated ball would be dip-coated with the gloss coat resin which would then be dried during a solvent removal process using heat and/or air flow; the overcoat layer should be approximately 100–200 microns thick. A second layer of gloss coating such as polyurethane could then be added using a spray-coating method. This second layer would be added to provide one additional barrier to moisture and to ensure an even gloss coating. The thickness of the gloss coating should be approximately 100 microns thick.

The resulting ball would thus contain a water-soluble dye encapsulated in thin film barrier. Permeation of water through a 100 micron thick polymer film, such as a polyurethane with a DK or diffusivity times solubility of 60 m2/sec-Pa would result in a diffusion half time for water of approximately 10 to 12 hours. The water would then be able to access the dye particles in the second layer containing dye encapsulant. The time for permeation of water through the gel encapsulant, assuming an inner radius of 40 microns and an outer radius of 50 microns, for a typical gelatin encapsulant, would be on the order of 5 to 6 hours, resulting in a color change after exposure to water of 16 to 18 hours, or essentially overnight. The time for permeation may be increased by using encapsulants or gloss barrier coatings with lower permeabilities. A nylon based overcoating would result in diffusion half-times approximately 100 times longer and the color change would then take place over the period of 100 to 160 hours or several days.

EXAMPLE 2

A second embodiment involves the use of a dye particle encapsulated in a water-soluble polymer such as polyethylene oxide or poly acrylic acid, by formation of a mixture of hard dye particles in a fluid prepolymer. The prepolymer could be, for example, a water soluble polyacrylamide resin with a temperature activated initiator and bisacrylamide crosslinker agent. The mixture would be added dropwise to an incompatible organic solvent such as toluene with an emulsifying agent such as polyvinyl alcohol with stirring at high speeds. The emulsified drops are polymerized when the emulsion is heated, and the resulting beads contain dye particles. This process can be adjusted to produce dye beads in varying sizes. 100 micron size beads would be produced for this application. The resulting beads should not be colored because the bead formation process is done in the absence of water under controlled conditions. The resulting beads are then isolated, and added in 1% by weight to a polyurethane gloss coating followed by a second barrier gloss coating. In this case, dye diffusion, would be dependent solely on the thickness of the outer barrier coating. Once, water reaches the dye particles, the polyacrylamide beads would swell, and dye diffusion through the polyacrylamide beads would be very rapid, resulting in the release of a very strong dye in the golf ball overcoating. As described in the first embodiment, diffusion through a barrier gloss coat could range from 10 to 100 hours depending on the polymer chosen for the coating. Polymers of choice include polyurethanes and nylons such as Nylon 6,6, Nylon 6 and Nylon 6,10.

EXAMPLE 3

In a third embodiment, a colorless compound called a color former is used. Color formers are converted to strong dyes when exposed to a developer. The developer is a slightly acidic clay or resin which absorbs or dissolves the color former and results in a colored dye. This technology is extremely well developed and has been used for thermal printing, electrochromic printing, and pressure sensitive (carbonless copy paper) industries. Colors achieved with these dyes include very deep black and blue shades that would be easily recognized against a white golf ball.

In this invention, the developer would be mixed in the gloss resin along with encapsulated particles containing the color former. Water diffusion would activate the developer, and water and developer would diffuse into the microparticle containing the color former. The resulting dye would then be released from the microparticle. In this example, a common color former known as Crystal Violet Lactone, which goes from colorless to blue in the presence of the developer, is encapsulated in a nylon microcapsule using interfacial polymerization.

In the polymerization process, the color former, which is organic and non-water soluble, is contained in an organic phase with a diacid chloride which is then contacted with a diamine in aqueous solution containing a weak base. The resulting emulsified droplets become microparticles for the carbonless copy paper industry and is well documented. A gloss resin can often be formulated to contain a commercially available color developer. A common developer is bisphenol A, which is cheap and fairly easy to process. A second choice, which is more effective developer and thus requires smaller quantities, but is more expensive, is zinc salicylate. Both compounds can be added to the encapsulant containing inner coating in small quantities—1 to 5 wgt. %.

The water diffusion process will involve the solubuilization of the water soluble developer. The water then acts as a carrier of the developer and delivers it via diffusion to the color former in the microparticles. The dye is then converted to a colored water soluble dye, which can diffuse out of the microparticle to produce a colored ball. For this example, the diffusion rates are dependent on the thickness of a second, barrier coating of polyurethane or nylon, which regulates the speed with which water reaches the first color former microparticles which again can be adjusted from 10 to 100 hours. The intensity or effectiveness of the system may be improved by putting the developer in, this outer coating, while the encapsulated color former remains in the inner coating.

All of the above examples involve the formation of a two layer gloss coating on the golf ball. The resulting release of dye from the inner layer will result in the coloration of the gloss coat and the underlying golf ball cover. The described invention may be used for detection of water absorption in two or three piece golf balls.

The processing steps required to manufacture golf balls are varied depending on the manufacturer and the final properties of this ball desired. This invention involves modification of the final finishing process steps in the manufacture of the golf ball. The application of the primer, label and the gloss coat are replaced by 1. Application of primer on the golf ball cover
2. Application of company logo or label
3. dip-coating of gloss coat with encapsulant particles onto ball
4. drying/solvent removal and/or cure of encapsulant containing gloss coat
5. spray coating of second gloss coat
6. drying or cure of second gloss coat Spinning or air flow may be used to dry the first coat and ensure a uniform coating. The thickness of the second coat should be fairly well controlled to ensure the appropriate amount of time before color change is activated.

A golf ball has thus been described which contains dye particles which are activated by the presence of water, resulting in a color change marker which effectively destroys the appearance of the ball, alerting the consumer to balls which have been exposed to water for inordinate amounts of time, and the potential for poor ball performance.

EXAMPLE 4

Figure 7:
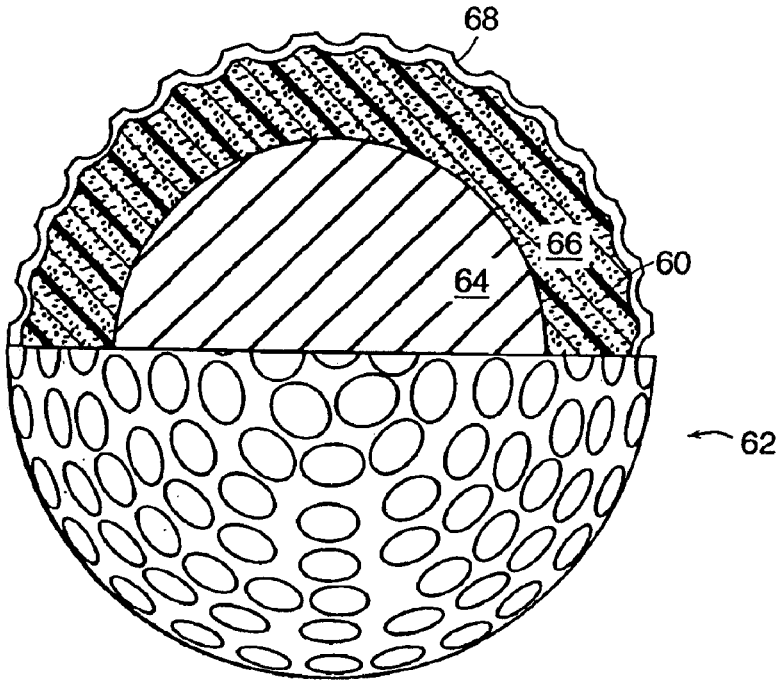
FIG. 7 is a diagrammatic illustration of another type two piece of golf ball.

The above describes the incorporation of dyes into an intermediate coating between the gloss coat and the golf ball cover. A different approach would involve the incorporation of dye into the golf ball cover itself. In this embodiment, illustrated in FIG. 7, dye 60 may be incorporated into the ionomer ball cover of a two piece golf ball 62 as a solid particle or as an encapsulated dye. Here the ball has a core 64 and a shell 66 which acts as a cover. Dyes are used which exist as solid, crystalline dye particles that are 10 to 40 microns in diameter. If such dyes can be compounded with the ionomer at temperatures below the dye melt point, the dye particles should main suspended in the polymer matrix without adversely coloring the ball Upon absorption of water into the ionomer cover, the dye would immediately begin to dissolve, producing a splotchy, colored appearance in the ball cover. In this case, the golf ball gloss coating 68 is the primary barrier to water, and as water permeates the gloss coating and begins to diffuse into the ball shell or cover 66, color change will occur. The use of an encapsulated dye could be used to obtain better control of the discoloration process. The dye encapsulant used would have to be chosen to withstand the compounding conditions of the ionomer ball.

Figure 8:
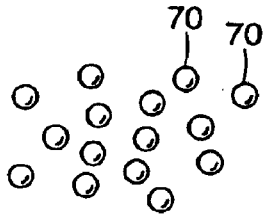
FIG. 8 is a diagrammatic representation of dye pellets used in the subject system.

In a further embodiment, as shown in FIG. 8, the dye or ink as the case may be can be provided in pelletized form as illustrated by pellets 70 for ease of manufacture. For instance, the dye can be compounded with polybutadiene or an ionomer resin respectively for a golf ball core or mantle/cover. The dye is compounded with surfactants or other additives to produce pellets which are then provided to the golf ball manufacturer to alleviate the need to handle otherwise volatile materials. The use of pellets also assures mixing in correct proportions for reliable dye release.

One skilled in the art is aware of the fact that there are various hues of the color white. Whereas, some embodiments include a noticeable change in that hue or color, other embodiments result in isolated changes in the appearance of the surface of the golf ball, such as to specific markings on the ball.

Figure 9:
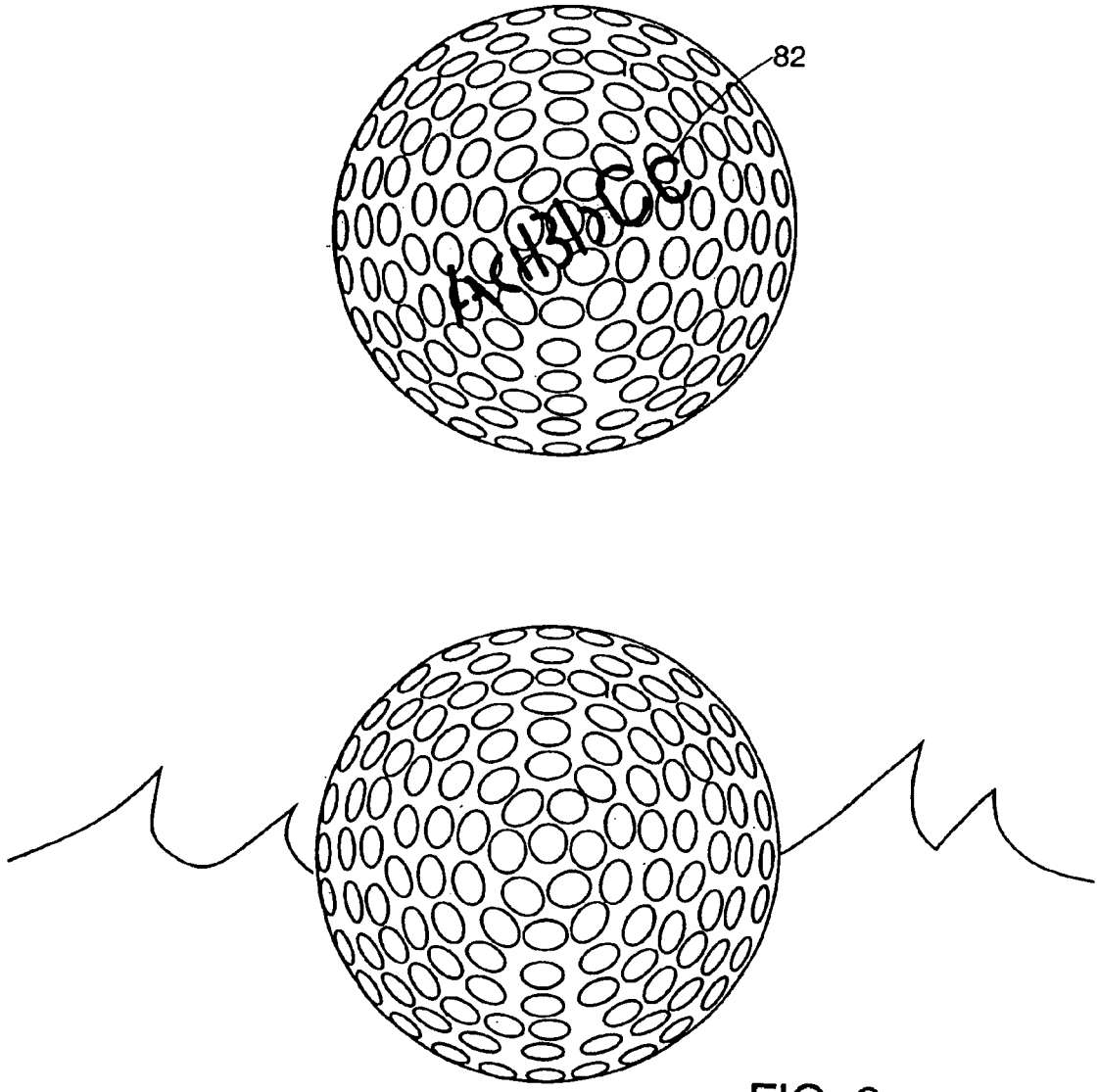
FIG. 9 is a perspective view of a golf ball with a water activated vanishing ink.
Figure 10:
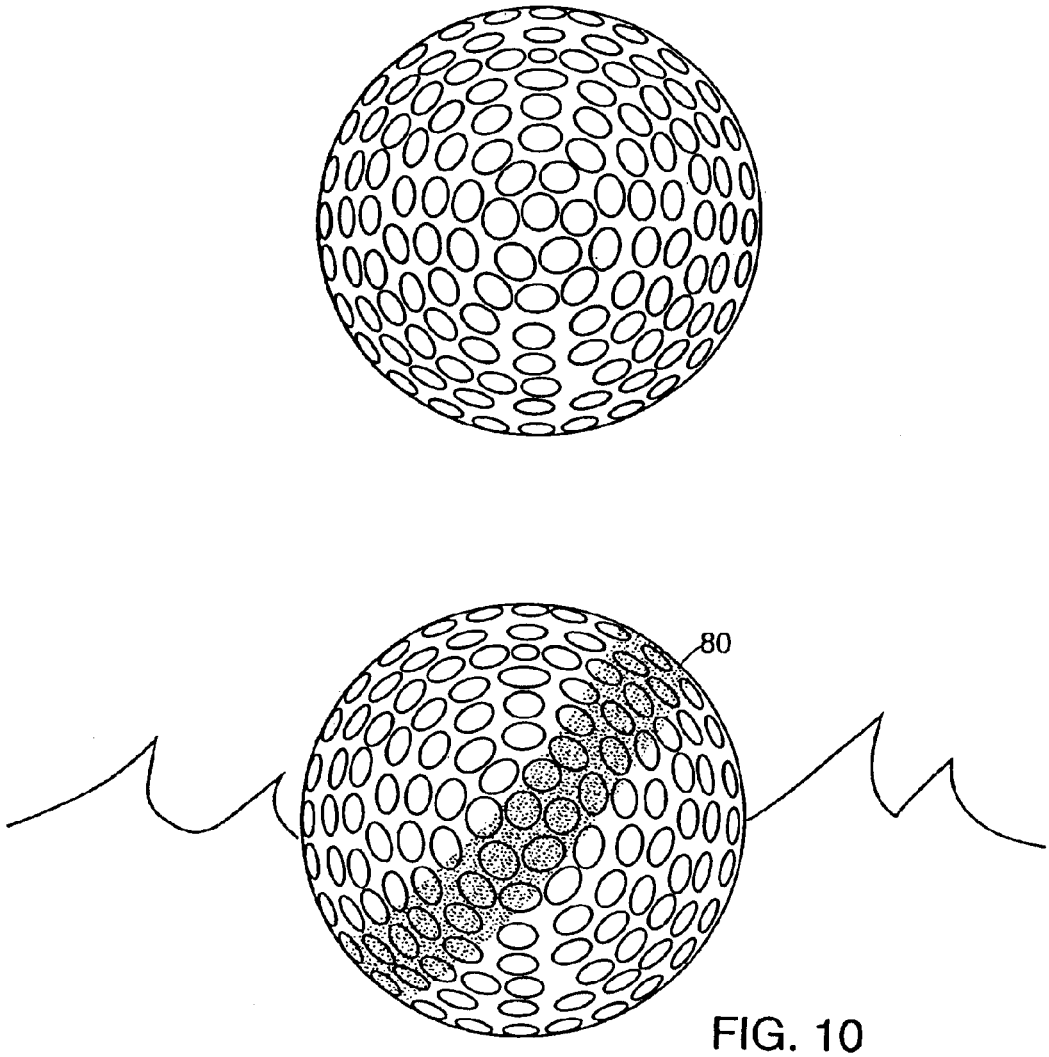
FIG. 10 is a perspective view of a golf ball with a water activated ink which appears when the ball is immersed.

Over the years, golf balls have been marked with a wide variety of marking compounds. Most commonly, markings made to golf balls, such as the imprint of the manufacturer and/or brand names, are generally accomplished through a pad printing ink process. In another embodiment of the present invention, water-activated inks are used to effectuate a change in appearance to the golf ball in one of two ways: (i) a marking 80 that is transparent but appears after exposure to water as shown in FIG. 10, or (ii) a marking 82 that is noticeable but vanishes upon exposure to water, as shown in FIG. 9. A suitable water-activated ink that is initially transparent and then appears when immersed in water is available from United Bio Technology, Inc. of Akron, Ohio under the trademark AquaClear. A suitable ink that is noticeable on the ball but that disappears upon immersion is sold under the trademark Aqua-Destruct by Sun Chemical of Cincinnati, Ohio. Such inks may be combined with resins in order to establish precise controlled degradation or release of the components that result in visual changes in appearance. Additionally, colors may be adapted to suit manufacturing preferences.

In other embodiments, oxidation-reduction chemistry can be used to generate reactions involving a change in the oxidation state of atoms or ions which results from the "loss" or "gain" (or partial transfer) of electrons, and as a result one can compound an ink or dye-like material that vanishes after being submerged in water for a period of time. The transfer of electrons between the atoms of these elements result in drastic changes to the elements involved. Due to the formation of ionic compounds, the changes that occur in the oxidation state of certain elements can be predicted quickly and accurately by the use of simple guidelines. The result of a combination reaction can also be reversed; in other words, a compound can be decomposed into the components from which it was formed. This type of reaction is called a decomposition reaction. Several known chemical structures are susceptible to oxidation and reduction by water. By utilizing these structures within the composition of an ink, the appearance of the ink can be manipulated upon exposure to water. The net effect of these reactions is that the ink becomes transparent or vanishes as the composite atoms are converted to their original oxidized and reduced states.

Having now described a few embodiments of the present invention, and some modifications and variations thereto, it should be apparent to those skilled in the art that the foregoing is merely illustrative and not limiting, having been presented by the way of example only. Numerous modifications and other embodiments are within the scope of one of ordinary skill in the art and are contemplated as falling within the scope of the invention as limited only by the appended claims and equivalents thereto.

What is claimed is:

1. A golf ball comprising:

one or more layers of construction;

water soluble dye embedded in said one or more layers of construction.

2. A golf ball of claim 1 wherein one of said layers of construction is a gloss coat, and wherein said dye is formed as a layer underneath said gloss coat.

3. A golf ball comprising:

one or more layers of construction;

water soluble ink embedded in said one or more layers of construction.

4. A process for manufacturing a golf ball comprising:

assembling a core of one or more layers of construction;

forming a cover over said core;

applying a primer over said cover;

dip coating a coating of water soluble dye over said primer;

applying a gloss coat over said coating of water soluble dye.

* * * * *